United States Patent [19]

Challenger

[11] Patent Number: 4,940,885

[45] Date of Patent: Jul. 10, 1990

[54] HEATING APPARATUS INCLUDING ULTRA-VIOLET PORTION

[76] Inventor: Wendall R. Challenger, 1838 Princess Dr., Longmont, Colo. 80501

[21] Appl. No.: 214,661

[22] Filed: Jul. 1, 1988

Related U.S. Application Data

[63] Continuation-in-part of Ser. No. 96,535, Sep. 15, 1987.

[51] Int. Cl.[5] ..... H05B 1/00; H05B 3/02; F24H 7/00

[52] U.S. Cl. ..... 219/365; 219/341; 219/369; 219/370; 219/374

[58] Field of Search ..... 219/521, 365, 339, 341, 219/350, 354, 358, 367, 368, 369, 370, 374

[56] References Cited

U.S. PATENT DOCUMENTS

| | | | |
|---|---|---|---|
| 3,261,964 | 7/1966 | Grossinger | 219/365 |
| 4,587,404 | 5/1986 | Smith | 219/365 X |
| 4,733,054 | 3/1988 | Paul | 219/521 X |

*Primary Examiner*—George H. Miller, Jr.
*Assistant Examiner*—Marvin M. Lateef
*Attorney, Agent, or Firm*—Donald W. Margolis

[57] ABSTRACT

A heat transfer fluid is used in a heating apparatus including, in series, a fluid storage container including conventional primary heating system for bulk heating the heat transfer fluid to a preselected temperature, and a secondary heating system utilizing an ultra-violet ray system for preheating the heat transfer fluid after it is cooled in a heat exchange system, but before it is returned to the fluid storage container. A connecting system is provided for transporting the heated fluid in series from the storage container, to the heat exchange system, to the ultra-violet ray heating system, and then back to the storage container. In operation, the fluid is heated in the storage container, and is then cooled as it passes through the heat exchange system. The cooled fluid is then preheated by the ultra-violet light ray heating system prior to its return to the storage container for further heating.

25 Claims, 1 Drawing Sheet

HEATING APPARATUS INCLUDING ULTA-VIOLET PORTION

RELATED APPLICATIONS

This application is a continuation-in-part of U.S. patent application Ser No. 096,535, filed Sept. 15, 1987.

BACKGROUND OF THE INVENTION (a) Field of the Invention

The present invention relates, generally, to heating devices using heat transfer fluid More specifically, the present invention relates to an improved heating system including heat storage means, heat exchange medium, and an ultraviolet light system to pre-heat the heat transfer fluid.

(b) Description of the Prior Art

Heating systems or furnaces are well known for heating single rooms or entire structures. Such heating systems generally include a fluid medium for receiving heat from a heat source. Traditional heat sources include, for example, gas, coal, or oil fueled flame heaters; electric resistance heaters, and solar heaters. In such systems heated fluid medium is and then directed by conduits, piping and the like, to the to-beheated location. Traditionally, fluid mediums utilized for this heat transferring function include air, water, oil, glycol, and the like. When the fluid medium reaches its destination point, it is directed through a heat exchanger such as a radiator, base board system, air register and cold air return, and the like, whereby heat from the fluid medium is dispersed in the vicinity of the heat exchange. This exchange of heat increases the temperature of the space surrounding the heat exchange, and likewise, removes heat from the fluid medium thereby cooling the fluid. The cooled fluid is then returned to the heating chamber to receive additional heat and is then recycled to the heat exchange system.

A traditional hot water heating system is disclosed in U.S. Pat. No. 2,154,021. In this instance, water is heated as the fluid medium and circulated through a heat exchange radiator at which a blower is utilized to pass air across the heat exchange tubes to extract the heat from the heat exchange to the surrounding area. The water is then returned to the storage and heating tank. U.S. Pat. No. 2,166,509 illustrates a slight variation of this particular system whereby vegetable oil is utilized as the fluid medium.

U.S. Pat. Nos. 3,079,087 and 3,891,817 disclose space heating systems illustrating various heating sources for the fluid medium. In these examples individual heating systems such as solar energy, electrical energy and microwave energy are utilized to heat the fluid medium. Variations on this theme are disclosed in U.S. Pat. Nos. 2,607,877 and 4,307,284. However, in these latter two references infra-red light energy is utilized to heat a fluid medium, which is either air or water, which medium is then directed to a heat exchange to extract the heat therefrom.

In all of these examples, a substantial amount of heat is necessary in the heating chamber in order to first raise the temperature of the fluid medium, and then to reheat the cooled fluid medium to a predetermined temperature before it is returned to the heat exchange. Such systems, require significant energy inputs in various form, and tend to be costly to run since a substantial heat input is necessary to the storage and heating chamber.

Other art known large commercial systems utilize waste heat for preheating the fluid medium prior to its heating or reheating in a fluid storage and heating chamber. However, in conventional space heating systems for homes and small buildings, there is no such waste heat available for fluid medium preheating. Thus, while the concept of preheating heat transfer fluid prior to the principal heating thereof is both known and very energy efficient, it is not applicable to space heating systems of the type described above. Thus, there is still a need for a heating furnace system for residential and small commercial structures which is efficient and inexpensive to operate.

SUMMARY OF THE INVENTION

Accordingly, it is one object of the present invention to provide an improved heating apparatus.

It is another object of the present invention to provide a furnace having a secondary heat generation system.

It is another object of the present invention to provide a heating system which is economical to operate and highly efficient in its fluid heating mode.

In accordance with the above and other objects and advantages of the invention, a heating apparatus is provided which utilizes a heat transfer fluid and a heat exchange connected to a primary heating and storage container. A mechanism is provided in the container for heating the transfer fluid therein to a predetermined temperature. A heat exchange system transfers heat from the fluid to the space surrounding the heat exchange system A mechanism is also provided for transporting heated fluid from the storage container to the heat exchange system and for returning cooled fluid from the heat exchange system to the storage and heating container. One or more pump moves the fluid through the apparatus. Finally, a mechanism is provided for preheating the cooled fluid prior to its return to the storage container, the preheating mechanism including a device for generating ultra-violet light to heat the fluid.

As noted above, in prior heating apparatus arrangements, the fluid has to be reheated in the storage and heating chamber after it leaves the heat exchange system in order to make up for the substantial temperature loss experienced at the heat exchange system. In the prior art this temperature loss is normally made up in its entirety in the fluid storage and heating chamber. Such arrangements pose certain problems, expenses and inefficiencies in as much as it takes considerable time and energy to heat a bulk volume of liquid over a large temperature range. The present invention avoids these problems of the prior art arrangements by introducing pre-conditioning or preheating apparatus into the system between the heat exchange system and the fluid storage and heating chamber.

These and other objects of the present invention will become apparent to those skilled in the art from the following detailed description, showing the contemplated novel construction, combination, and elements as herein described, and more particularly defined by the appended claims, it being understood that changes in the precise embodiments of the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF THE PREFERRED EMBODIMENTS

Figure 1:
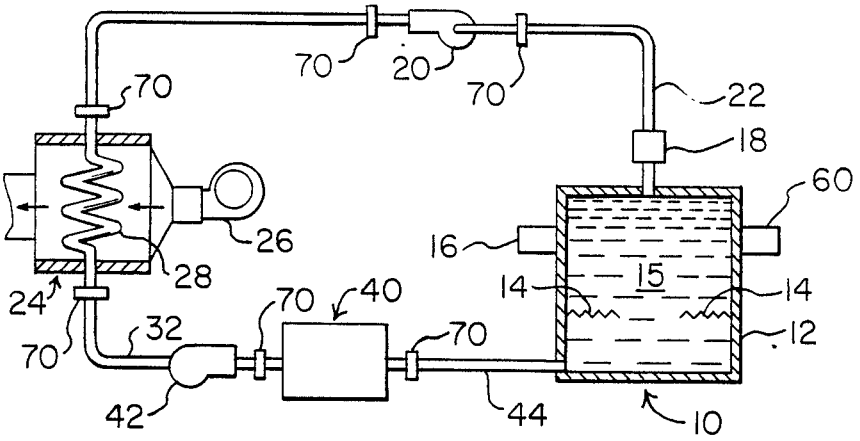
FIG. 1 is a schematic diagram of the devise of the heating system of the present invention.

Referring to FIG. 1, a space heating system, generally 10 is provided. Furnace 10 includes heat transfer fluid storage tank 12 having, for example, a pair of electric heater elements 14 disposed therein. Fluid storage tank 12 serves to both store heat transfer fluid 15 therein as well as to provide a reservoir for heating such heat transfer fluid to operational temperatures, as detailed below. While any appropriate heat transfer fluid medium may be utilized with the present invention, such as water, air, oil, glycol, and the like, oil is the preferred medium. Specifically, the optimum medium for the present invention has been found to be a low viscosity high heat capacity oil comprised substantially of approximately 75% by volume vegetable oil, 10% by volume olive oil, and 15% by volume of lecithin The lecithin is believed to lubricate the system and permits fluid 15 to have a very high circulation rate within the system, as detailed below.

Thermostat 16, associated with fluid storage tank 12 is provided for sensing the temperature of the fluid within fluid storage tank 12. Thermostat 16 is operatively linked to fluid pump 20, and when predetermined temperatures are reached it activates pump 20 which then circulates fluid 15 throughout system 10.

While the preferred operational temperature of the heat transfer fluid will depend upon the use to which the system is to be placed and the heat stability of the heat transfer fluid, a home or small commercial complex heating furnace using the preferred oil-based fluid of the present invention, as described above, has a preferred operational temperature in the range of about 220°-250° F. (104°-121° C.), with the optimum temperature being about 240° F. (116° C.). Thus, when the temperature of heat transfer oil 15 within tank 12 reaches 240° F. (116° C.), thermostat 16 is set to activate and open valve 18 of tank 12 and initiates operation of pump 20 to deliver heated fluid from tank 12 into conduit 22 and thence to heat exchange system 24.

Heat exchange system 24 may be any appropriate exchange or radiator, whereby the heat from heat transfer fluid 12 which enters into exchange 24 is dissipated into the space surrounding exchange 24, or is otherwise beneficially utilized. To assist in this heat dissipation, for example in a forced air heating system, a blower 26 is utilized to move air across coil 28 of exchange 24 to quickly and efficiently move the heat from the heat transfer fluid in coil 28. Coil 28 is a hollow tube, and is preferably constructed of a highly heat conductive material, such as copper, brass or the like. Accordingly, heat is transferred from fluid 15 to the space surrounding coil 28, thereby providing heat to the forced air heating system. As a result of the fact that heat is thus removed from heat transfer fluid at heat exchange coil 28, the temperature of the fluid as it exits coil 28 is substantially reduced. For example, in the embodiment shown and described the heat transfer fluid may be cooled from about 240° F. (116° C.), as it enters coil 28, to about 140° F. (60° C.), and below as it exits from coil 28. The thus cooled fluid then enters return conduit 32 and is recirculated from exchange 24 to tank 12 for re-heating to its predetermined preferred operative temperature of about 240° F. (116° C.).

The present invention provides preconditioning or preheating apparatus 40 in series with return conduit 32. Preheating apparatus 40 is operatively linked to a second fluid pump 42. In preferred embodiments, preheater 40 is an ultraviolet heating chamber of the kind set forth in detail in FIGS. 2 and 3. In the example illustrated, preheater 40 increases the temperature of the returning fluid and adds at least approximately 30° F. (16.7° C.) to the temperature of the cooled fluid before it re-enters tank 12 In the example shown, the preheater 40 heats the transfer fluid therein to a temperature of about at least 180° F. (82° C.) as it exits from preheating chamber 40 into conduit 44 and thence into tank 12. In this manner, tank 12 need only increase the temperature of the returning fluid about 60° F. (33° C.) instead of 100° F. (56° C.) as it would without the preheating arrangement of the present invention. Accordingly, the re-heating of cooled fluid 15 within chamber 12 can take place over a much shorter period of time and with considerably less energy demand on heating elements 14.

Figure 3:
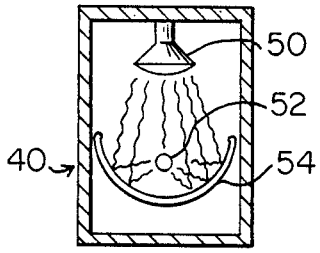
FIG. 3 is a cross-sectional view taken substantially along line 3—3 of FIG. 2.
Figure 2:
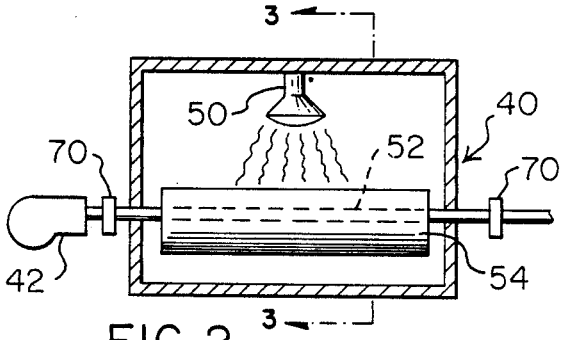
FIG. 2 is an enlarged schematic diagram of the ultraviolet heat chamber utilized with the present invention.

Now, referring more particularly to FIGS. 2 and 3, ultraviolet chamber 40 is shown to include an ultra-violet light 50 which is designed to generate substantially only ultra-violet radiation. In the preferred form, a 275 Watt ultra-violet light source is utilized. In preferred embodiments ultra-violet light 50 has substantially all of its radiation in the range of about 260 to 330 nm, that is substantially in the center of the ultraviolet radiation band. Some small amount of light in the high blue range may be produced by light 50, but no infrared radiation is intentionally produced by the bulb.

In operation, cooled heat transfer fluid 15 is directed from heat exchange system 28, through conduit 32, and into heat transfer tube 52. Transfer tube 52 is narrower in diameter than conduits 22 and 32. Thus, because of its relatively larger surface area to fluid volume ratio, heat is more readily transferred into the fluid in smaller diameter tube 52. In its preferred form, tube 38 comprises, for example, a ¾th inch outside diameter brass tube, although any appropriate high heat conductivity material may be utilized to construct tube 52.

Tube 52 is disposed substantially adjacent ultra-violet light source 50 so as to be exposed to the rays therefrom. In order to concentrate the ultra-violet energy from light source 50 onto tube 52, and thus into the fluid passing through tube 52, a parabolic reflector, such as mirror 54 is preferably provided. In its preferred form, mirror 54 extends substantially the length of tube 52 within chamber 40, and is positioned so that tube 52 is coaxial with the focal line of parabolic mirror 54. In this manner, substantially all of the rays from light source 50 are projected on to and reflected from mirror 54. When the rays are reflected from mirror 54, they are concentrated along its focal line thereof which is occupied by heat transfer tube 52. In this manner, the ultra-violet rays from light 50 are concentrated on tube 52, and thus the heat is conducted into the fluid passing through tube 52. This arrangement results in the rapid increase of the temperature of the fluid therein by at least 30°–40° F. (17°–22° C.) as it passes through chamber 40.

In its preferred form, the fluid normally enters chamber 40 from conduit 32 at approximately 140° F. (60° C.) and is warmed therein to at least 180° F. (82° C.). The high speed at which the fluid is heated as it passes through chamber 40, and the relatively small amount of energy required to operate the ultraviolet light source is minimal compared to the temperature increase and energy absorbed by the fluid passing through chamber 40 makes the use of this preheating system very beneficial and efficient. The amount of energy used to preheat the fluid in chamber 40 is considerably less than the amount of energy that would be required for heating elements 14 to generate the entire temperature increase of the fluid within tank 12.

Interestingly, when infra-red light sources and visible light sources of comparable wattage have been substituted in chamber 40 for ultra-violet light 50 it has been found that the amount of heating of the fluid is nominal. In fact the system has been found to experience significant heat loss inefficiencies when infra-red, and incandescent light sources are used.

In its preferred form, pumps 20 and 42 are both Dayton pumps having a flow rate of about 5 gallons per minute, and are capable of operating with fluids not to exceed 250° F. (121° C.). The blower system 26 may comprise a ⅓ horsepower motor ranging from 875 cfm up to 2100 cfm. The two immersion heaters 14 may comprise 1500 Watt electric heaters.

Also illustrated in FIG. 1, for safety and economy reasons, is a second thermostat 60 is associated with container 12. Second thermostat 60 acts as a high limit safety switch, and will turn off the entire system if a high temperature, say 390° F. (199° C.) is reached in tank 12. The wiring, electrical components, and sequencing of the operation of the system, which are not shown, are all substantially state of the art and follow Underwriters Laboratories standards and requirements for heating systems of this kind. FIG. 1 also illustrates a plurality of shut-off valves 70 disposed about the system. Shut-off valves 70 permit the various conduit lines 22, 32 and 44 to be sealed so as to enable replacement of component portions of apparatus 10 without significant spillage or loss of transfer fluid 15.

Devise 10 may be incorporated into a household or commercial heating system. In that event a conventional room or area thermostat (not illustrated) will be integrated with device 10 so that as the conventional thermostat signals for heat, blower 26 engages and discharges air through exchange 24. In addition, pumps 20 and 42 start circulating fluid through apparatus 10 so as to maintain the operational temperature of the unit at approximately 220°–250° F. (104–121° C.).

Figure 4:
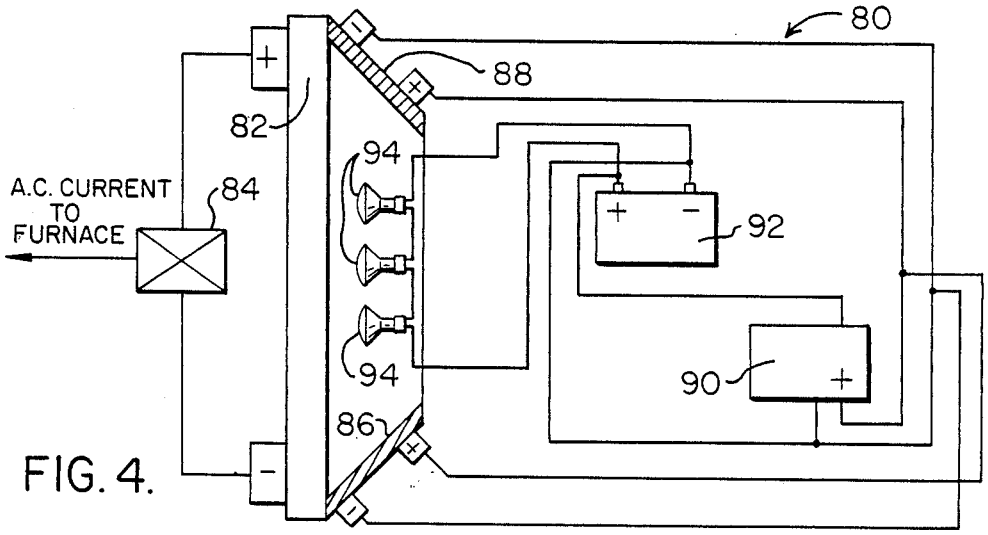
FIG. 4 is a schematic diagram of one preferred A.C. electric power source which is used in association with the heating system of the present invention.

Now, referring to FIG. 4, a preferred A.C electric power supply system is shown schematically and diagrammatically. This power system, generally 80, includes a photovoltaic D.C. electricity generating system. The photovoltaic D.C, electricity generating system includes a first relatively high voltage output photovoltaic cell 82 capable of generating, for example, about 15 amps (120 volts) of D.C. electricity. Electricity from photovoltaic cell 82 is passed through converter 84 which changes the current from D.C. to A.C., and thence transmits the electric power to the furnace to operate all of its electrical functions, including the primary heating, the secondary heating, the pumps and so on.

Associated with photovoltaic cell 82 are a pair of smaller photovoltaic units 86 and 88 which, when illuminated generate and pass the D.C. current generated by them through voltage regulator 90 and thence to battery 92, for example a 12 volt, 200 amp battery, for example, of the type normally utilized in automobile operations. Connected in operating series to battery 92 is a light source, in this example a group of three incandescent lights 94, In preferred embodiments lights 94 are 12 volt quartz lights.

In operation, lights 94 are lit and powered by D.C. current from battery 92 to produce electromagnetic radiation. The electromagnetic radiation produced by lights 94 is directed to photovoltaic cell 82, and also to photovoltaic cells 86 and 88. The power produced by photovoltaic cell 82 is passed to converter 84, converted to A.C. current, and then used to power the furnace system 10 of the present application. The D.C. power produced by photovoltaic cells 86 and 88 is passed through voltage regulator 90 and thence to battery 92, to recharge battery 92. This normally keeps battery 92 fully or substantially charged at all times to provide a permanent supply of power to operate lights 94. However, should battery 92 be found to be losing, or to have lost its charge, it can be recharged from an external D.C. power source in the manner which is well known in the art.

In preferred embodiments, a plurality of photovoltaic systems 82, 86 and 88, with a like number of light systems 94, will be utilized, with for example a single current converter 84, a single regulator 90, and a single battery 92 to provide the required power and control to the furnace system of the present invention.

As can be seen from the above, the present invention provides for a simple yet efficient heating system utilizing a low cost energy source, that is ultraviolet radiation, for preheating or preconditioning heat transfer system of the fluid. In this manner, the storage and heating tank of the system is not required to provide all of the heat to the system at a point when the liquid is present in a large quantity The amount of energy traditionally needed to heat a large body of fluid a substantial amount is considerable as compared to heating the body of fluid only a portion of the required amount and preheating the fluid prior to entering the storage tank. Inasmuch as ultraviolet radiation is utilized as a secondary heat source by the present invention, such secondary heat sources may be operated very economically and quickly in terms of raising the temperature of the fluid transfer medium a significant amount compared to the amount of energy and time required to achieve such temperature changes in the primary heating tank. Thus, by utilizing the preheating mechanism of the present invention, the fluid storage tank need only raise the temperature of the fluid entering the tank a much smaller amount as compared to prior devices requiring large temperature increases. The preheating increases the temperature of the inflow fluid before it is returned to the primary heating container, and thereby significantly reduces the cost and efficiency of operating the main heating unit in the storage tank, while overall significantly decreasing the cost of operation. Since a concentrated ultraviolet light arrangement is utilized, as described above, the energy generated by the preheating apparatus is effectively utilized with little heat loss, Thus, the present invention provides economically operated electric furnace arrangement for use either as a supplemental heater or as a sole source of heat for a residential or small commercial structure.

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

The embodiments of the invention in which an exclusive property or privilege is claimed are defined as follows:

1. A heating system using heat transfer fluid, comprising:

means for storing heat transfer fluid, when such fluid is present in such a system;

primary means for heating heat transfer fluid to a preselected temperature, said primary heating means being associated with said heat transfer fluid storing means;

means for utilizing heated heat transfer fluid;

means for transporting heated heat transfer fluid from said heat transfer fluid storing means to said heat utilizing means, whereby, heat energy from heated heat transfer fluid when such fluid is present in such system is transferred to an area external to the heating system, and, as a result of which the heat transfer fluid is cooled;

means for transporting cooled heat transfer fluid, when present, from said heat utilizing means back to said heat transfer storage means;

secondary means for heating fluid, when present, after such fluid is cooled at said heat utilizing means and prior to the return of such cooled fluid to said storage means, said secondary heating means being located intermediate said heat utilizing means and said heat transfer storage means and in fluid series with said means for transporting cooled heat transfer fluid from said heat utilizing means back to said heat transfer storage means; whereby such fluid, when present and cooled at said heat utilizing means, is preheated before it is returned to said heat transfer fluid storing means.

2. The system as claimed in claim 1, wherein said means for utilizing heat is a first heat exchange system, and wherein said secondary heating means includes means for producing ultraviolet light rays, which ultraviolet light rays can be used to preheat said fluid.

3. The system as claimed in claim 2, wherein said fluid storage means comprises a container including substantially therein said primary means for heating fluid when present,

4. The system as claimed in claim 3, wherein means to control the temperature to which heating fluid is heated is associated with said primary means for heating fluid.

5. The system as claimed in claim 4, wherein said means to control the temperature to which heating fluid is heated is a thermostat

6. The system as claimed in claim 5, wherein said thermostat controls the temperature to which heating fluid is heated to a temperature in the range of about 220° F. to about 250° F. (104°-121° C.) prior to transporting such fluid to said first heat exchange means.

7. The system as claimed in claim 3, wherein said primary means for heating fluid is an electric heater

8. The system as claimed in claim 6, wherein said primary means for heating fluid is an electric heater.

9. The system as claimed in claim 8, wherein said secondary heating means is adapted to increase the temperature of such fluid to approximately 180° F. (82° C.) prior to the return of such fluid to said fluid storage means.

10. The system as claimed in claim 2, wherein said secondary heating means is adapted to add sufficient heat to such fluid to increase the temperature, thereof, by at least approximately 30° F. (16.7° F.).

11. The system as claimed in claim 2, wherein said wherein said secondary heating means further includes a second heat exchange means disposed adjacent to said ultra-violet light source, said second heat exchange means being adapted to receive therein cooled heat transfer fluid from said first heat exchange means, whereby such fluid, when present and cooled at said first heat exchange means is preheated within said second heat exchange means by said ultra-violet rays.

12. The system as claimed in claim 11, wherein means for concentrating ultra-violet light rays on said second heat exchange means are included with said means for secondary heating of fluid.

13. The system as claimed in claim 12, wherein said ultraviolet light concentrating means comprises a reflector having a focal point which is substantially coextensive with said second heat exchange means.

14. The system as claimed in claim 13, wherein said reflector is substantially parabolic and it has a focal line which is substantially coextensive with said second heat exchange means.

15. The system as claimed in claim 13, wherein said reflector is a mirror.

16. The system as claimed in claim 14, wherein said reflector is a mirror.

17. The system as claimed in claim 11, wherein said second heat exchange means includes at least one hollow tube constructed of heat conductive material, said tube in fluid series with said means for transporting cooled heat transfer fluid from said first heat exchange means back to said heat transfer storage means.

18. The system as claimed in claim 11, wherein said secondary heating means also includes means to control the flow of fluid through said secondary heating means.

19. The system as claimed in claim 18, wherein said means to control the flow of fluid through said secondary heating means is a fluid pump.

20. The system as claimed in claim 2, wherein said means for producing ultra-violet light includes a high Wattage ultraviolet light bulb.

21. The system as claimed in claim 18, wherein said ultraviolet light bulb has a Wattage of about 275 Watts.

22. The system as claimed in claim 1, wherein their is heat transfer fluid present in said heating system.

23. The system as claimed in claim 22, wherein their is said heat transfer fluid includes oil.

24. The system as claimed in claim 23, wherein said heat transfer fluid comprises a mixture of approximately 75% by volume vegetable oil, 10% by volume olive oil, and 15% by volume of lecithin.

25. The system as claimed in claim 2, wherein said system further includes blower means to direct air across said first heat exchange means to increase the transfer of heat from the fluid therein to the space surrounding said heat exchange means.

* * * * *